US010632392B2

(12) United States Patent
Simmons

(10) Patent No.: US 10,632,392 B2
(45) Date of Patent: Apr. 28, 2020

(54) WALKING DOLL 4

(71) Applicant: Deborah Simmons, New York, NY (US)

(72) Inventor: Deborah Simmons, New York, NY (US)

(73) Assignee: UNEEDA DOLL COMPANY, LTD., Henderson, NC (US)

( * ) Notice: Subject to any disclaimer, the term of this patent is extended or adjusted under 35 U.S.C. 154(b) by 0 days.

(21) Appl. No.: 15/713,688

(22) Filed: Sep. 24, 2017

(65) Prior Publication Data

US 2018/0099229 A1 Apr. 12, 2018

Related U.S. Application Data

(63) Continuation-in-part of application No. 15/430,464, filed on Feb. 11, 2017, which is a continuation-in-part of application No. 15/202,500, filed on Jul. 5, 2016.

(60) Provisional application No. 62/358,013, filed on Jul. 3, 2016, provisional application No. 62/209,537, filed on Aug. 25, 2015.

(51) Int. Cl.

| | |
|---|---|
| ***A63H 11/18*** | (2006.01) |
| ***A63H 3/46*** | (2006.01) |
| ***A63H 7/00*** | (2006.01) |
| ***A63H 3/20*** | (2006.01) |
| ***A63H 7/02*** | (2006.01) |

(52) U.S. Cl.

CPC ..... *A63H 11/18* (2013.01); *A63H 3/20* (2013.01); *A63H 3/46* (2013.01); *A63H 7/02* (2013.01)

(58) Field of Classification Search

CPC ..... A63H 3/20; A63H 3/46; A63H 7/00

See application file for complete search history.

(56) References Cited

U.S. PATENT DOCUMENTS

| | | | | | |
|---|---|---|---|---|---|
| 2,621,443 | A | * | 12/1952 | Black | A63H 7/00 446/317 |
| 2,829,466 | A | * | 4/1958 | Winkler | A63H 7/00 446/317 |
| 3,125,829 | A | * | 3/1964 | Ostrander | A63H 7/00 446/317 |
| 3,445,956 | A | * | 5/1969 | Doppelt | A63H 7/00 446/317 |

* cited by examiner

*Primary Examiner* — John A Ricci

(74) *Attorney, Agent, or Firm* — Nyemaster Goode P.C.

(57) ABSTRACT

A walking doll that produces a satisfying walking motion when assisted and vertically supported by a person holding the doll's hand and guiding the doll forward and from leg to leg, causing the weight to shift from leg to leg, and when the weight is relieved from one leg, that unweighted leg swings forward as a result of the influencing force of an internally located spring-like material, allowing each respective leg to move forward for the next step as weight is shifted from leg to leg.

11 Claims, 7 Drawing Sheets

WALKING DOLL 4

PRIORITY

This application is a continuation-in-part of application Ser. No. 15/430,464 filed Feb. 11, 2017 and claims priority to application Ser. No. 15/430,464 which is incorporated in its entirety herein by this reference and which is a continuation-in-part of application Ser. No. 15/202,500 filed on Jul. 5, 2016 and claims priority to application Ser. No. 15/202,500 which is incorporated in its entirety herein by this reference. This application also claims priority to U.S. Provisional Utility Patent Application No. 62/209,537 for the invention titled "WALKING DOLL" with a filing date of Aug. 25, 2015, which is incorporated herein by reference for all purposes. This application also claims priority to U.S. Provisional Utility Patent Application No. 62/358,013 for the invention titled "WALKING DOLL" with a filing date of Jul. 3, 2016, which is incorporated herein by reference for all purposes. This application claims the benefit of PCT/US16/41661 filed on Jul. 9, 2016 which is incorporated herein by this reference.

BACKGROUND OF THE INVENTION

The field of dolls, more specifically, the field of walking dolls.

There have been walking dolls based on complicated clockwork mechanisms since the renaissance, with increasing popularity in the eighteenth and nineteenth centuries. Dolls with complicated mechanisms could only be afforded by the upper class, as these mechanisms were hand constructed, fairly delicate curios, and more works of kinetic art than utilitarian toys for average people. With the advent of plastic and the cheaper manufacturing and mass production of the twentieth century, dolls as toys for the average person of average means became more available, and ultimately ubiquitous. Many of these dolls were combinations of plastic and plush, some more realistic than others in their anthropomorphism of the human form.

As with all toys, the goal has always been the creation of a product with the most play value for the least money. The present doll strikes that balance with a unique mechanism that marries simplicity with human interaction to produce a dramatic walking action and play pattern coupled with high perceived value.

SUMMARY OF THE INVENTION

The present invention is a walking doll that appears to walk with the assistance of a person supporting and balancing the doll. The doll can be any size, but is generally assumes a size large enough to be both satisfyingly-large and to act as a companion for a child who is walking her own baby doll. The doll is anatomically similar to a human, with a head, torso, moveable and positionable arms, and two legs that can move forward and backward relative to the torso and a center position of each respective leg, and that have internal springs or rubber bands that can restore the legs angularly to their respective center positions. The user holds the doll's hand and supports the doll in an upright position while walking with the doll. By shifting the doll's weight from leg to leg while engaging in and producing forward motion, the legs snap back or return to a central position propelled by the action of an internal spring or rubber band. There are several mechanisms that can create both the displacing force to move the legs forward and also the restorative force to return the legs to center position.

In its present embodiment, the invention is an assisted walking doll comprising of a torso with a left hole or socket and a right hole or socket, two moveable arms, and head. There is also a left leg with a left grooved femur ball at one end, with the left grooved femur ball having attached a left leg hook, a left attachment zone located on the left side of the torso, a left elastic band with a first end attaching to the left leg hook and a second end attaching to the left attachment zone, and the left elastic band is stretched in tension, thus generating a compressive force between the left grooved femur ball and corresponding leg and the left hole or socket, with the left leg being stabilized by the groove of the left grooved femur ball being mated with the left hole or socket. And there is also a right leg with a right grooved femur ball at one end, with the right grooved femur ball having attached a right leg hook, a right attachment zone located on the right side of the torso, a right elastic band with a first end attaching to the right leg hook and a second end attaching to the right attachment zone, and the right elastic band is stretched in tension, thus generating a compressive force between the right grooved femur ball and corresponding leg and the right hole or socket, with the right leg being stabilized by the groove of the right grooved femur ball being mated with the right hole or socket.

The invention can further comprise of a restorative force alteration subsystem. This subsystem can take any number of forms, and functionally what it does is alter the restorative force transfer function of a simple spring returning the leg to its undisturbed equilibrium position. Normally, when a spring or rubber band would return the leg to the center position, the greater the angle of leg displacement off the center position, the greater the restorative force, and the restorative force would be monotonically increasing with increasing angular displacement off the center position. This restorative force is not quite linear, but to a first order approximation, the restorative force is almost directly proportional to and a linear function of the angular displacement of the leg from the center position. The restorative force alteration subsystem makes that restorative force more non-linear, and this can produce any number of interesting actions and force functions that can enhance the play pattern and increase the perceived value of the doll. This can include both greater and lesser increasing force as a function of angular displacement off the center line of the leg and torso.

The restorative force alteration subsystem can comprise of a left cam plate fixed within the torso and an expandable left cam follower attached to and/or incorporated within the left grooved femur ball and correspondingly on the right side a similar subsystem that can comprise a right cam plate fixed within the torso and an expandable right cam follower attached to and/or incorporated within the right grooved femur ball.

The cam follower is not limited to the embodiment of a coil spring encased within a pair of overlapping cups compressing into one another. It can just as easily be a leaf spring or folded leaf spring similar to the shape of a safety pin, a plastic living spring, or it can be a compressible piece of rubber or other spongy material that can be compressed and can return to an unstressed position depending on compression.

The left cam plate can produce a lesser and/or different restorative force than would be experienced without said restorative force alteration subsystem by the left leg when angularly displaced off the center line created by the left leg and the torso and the right cam plate can produce a lesser and/or different restorative force than would be experienced without the restorative force alteration subsystem by the right leg when angularly displaced off the center line created by the right leg and the torso.

The left hole or socket that mates with the groove of the left grooved femur can be oriented to travel within a left plane diagonally oriented to the central axis of the torso and the right hole or socket that mates with the groove of the right grooved femur can be oriented to travel within a right plane diagonally oriented to the central axis of the torso, and the left plane can be a mirror image of the right plane relative to a vertically oriented plane passing from the front of the torso to the back of the torso. The cam plate and cam follower can be made of a slippery low friction material that can withstand the wear produced by repeated cycles of walking. Such materials might include but are not limited to nylon, Delrin, Teflon, or other material.

In another embodiment, the invention can be an assisted walking doll comprising of a torso with a left hole or socket and a right hole or socket, two moveable arms, and head, a left leg with a left grooved femur ball at one end, with the left grooved femur ball having attached a left leg hook, a right leg with a right grooved femur ball at one end, with the right grooved femur ball having attached a right leg hook, a rotatable pulley and/or grooved member with an axis of rotation that passes from the front of the torso to the back of the torso, or alternatively, a non-rotating solid member connected to the front of the torso and/or to the back of the torso, an elastic band with a first end attaching to the left leg hook and a second end attaching to the right leg hook, and the elastic band can pass over the pulley or the solid member. The elastic band can be stretched in tension, and thus generate a compressive force between the left grooved femur ball and corresponding leg and the left hole or socket and a compressive force between the right grooved femur ball and corresponding leg and the right hole or socket, with the left grooved femur ball and corresponding leg being stabilized by the groove of the left grooved femur ball being mated with the left hole or socket and with the right grooved femur ball and corresponding leg being stabilized by the groove of the right grooved femur ball being mated with the right hole or socket.

The invention can further comprise of a restorative force alteration subsystem. The restorative force alteration subsystem can comprise of a left cam plate fixed within the torso and an expandable left cam follower attached to and/or incorporated within the left grooved femur ball and a right cam plate fixed within the torso and an expandable right cam follower attached to and/or incorporated within the right grooved femur ball. The left cam plate can produce a lesser and/or different restorative force than would be experienced without the restorative force alteration subsystem by the left leg when angularly displaced off the center line created by the left leg and the torso and the right cam plate can produce a lesser and/or different restorative force than would be experienced without the restorative force alteration subsystem by the right leg when angularly displaced off the center line created by the right leg and the torso. The left hole or socket that mates with the groove of the left grooved femur ball can be oriented to travel within a left plane diagonally oriented to the central axis of the torso and the right hole or socket that mates with the groove of the right grooved femur ball can be oriented to travel within a right plane diagonally oriented to the central axis of the torso, and the left plane can be a mirror image of the right plane relative to a vertically oriented plane passing from the front of the torso to the back of the torso. The cam plate and cam follower can be made of a slippery low friction material that can withstand the wear produced by repeated cycles of walking. Such materials might include but are not limited to nylon, Delrin, Teflon, or other material.

The invention can further comprise a method of operating an assisted walking doll comprising of the following steps: supporting the assisted walking doll by holding at least one arm, tilting the assisted doll to the left such that the majority of the doll's weight is supported on the doll's left leg and leading the doll forward so the right leg moves in front of the left leg such that the right leg and left leg form an angular separation between a finite angle of separation and a maximum angle limited by the freedom of the left leg mechanism, or if one starts with the other leg, tilting the assisted doll to the right such that the majority of the doll's weight is supported on the doll's right leg and leading the doll forward so the left leg moves in front of the right leg such that the left leg and right leg form an angular separation between a finite angle of separation and a maximum angle limited by the freedom of the right leg mechanism, tilting the assisted doll from the left to the right such that the majority of the doll's weight is supported on the doll's right leg and leading the doll forward so the left leg moves in front of the right leg such that the left leg and right leg form an angular separation between a finite angle of separation and a maximum angle limited by the freedom of the right leg mechanism, or tilting the assisted doll to from the right to the left such that the majority of the doll's weight is supported on the doll's left leg and leading the doll forward so the right leg moves in front of the left leg such that the right leg and the left leg form an angular separation between a finite angle of separation and a maximum angle limited by the freedom of the left leg mechanism. These steps can be repeated any number of times, shifting the dolls weight from the right to the left to the right and so on.

Although preferred embodiments of the present invention have been described it will be understood by those skilled in the art that the present invention should not be limited to the described preferred embodiments. Rather, various changes and modifications can be made within the spirit and scope of the present invention.

BRIEF DESCRIPTION OF THE SEVERAL VIEWS OF THE DRAWING

The drawings constitute a part of this specification and include exemplary embodiments to the invention, which may be embodied in various forms. It is to be understood that in some instances various aspects of the invention may be shown exaggerated or enlarged to facilitate an understanding of the invention.

FIG. 1 (which is comprised of 1A, 1B, 1C more specifically described below) depicts a simplified leg and socket system in three positions.

FIG. 3 (which is comprised of 3A, 3B, 3C more specifically described below) depicts three positions of a simplified leg and socket system incorporating an expandable cam follower. For simplicity, elements of FIG. 1 are not shown.

DETAILED DESCRIPTION OF THE INVENTION

Detailed descriptions of particular embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

FIG. 1 depicts a simplified leg and socket system in three positions.

Figure 1A:
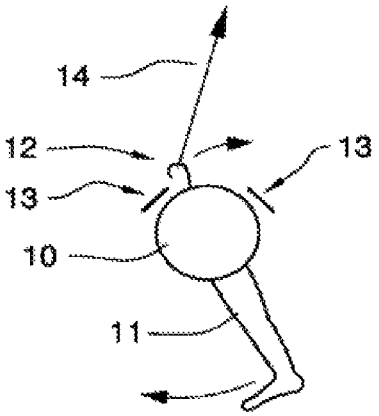
FIG. 1A depicts a simplified leg and socket system with a restorative force in the clockwise direction.

FIG. 1A depicts a simplified leg and socket system with a restorative force in the clockwise direction. A hook 12 is affixed to ball 10, and one end of elastic band 14 is attached to hook 12. The other end of the elastic band 14 is not shown for clarity, but is affixed above in such a manner that when under tension it produces a compressive force between the ball 10 and the hole or socket 13. Leg 11 is affixed to ball 10 and located on the opposite side of hook 12 or mostly on the opposite side of hook 12. There can be some deliberately offset to apply an appropriate positional bias as to where the center position of the leg 11 is.

Figure 1B:
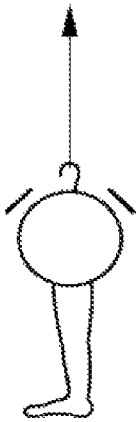
FIG. 1B depicts a simplified leg and socket system in a centered equilibrium position.

In FIG. 1B (components not labeled for clarity but the same as in FIG. 1A) this system is shown in the centered equilibrium position, such that when elastic band 14 is pulled upward the hook 12 is also pulled upward, and leg 11 tends to remain centered. In FIG. 1A, when the hook 12 is off-center to the left, the leg 11 is off-center to the right, and a restorative force tends to rotate the leg 11 in the clockwise direction.

Figure 1C:
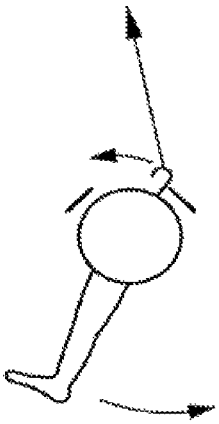
FIG. 1C depicts a simplified leg and socket system with a restorative force in the counter-clockwise direction.
Figure 1D:
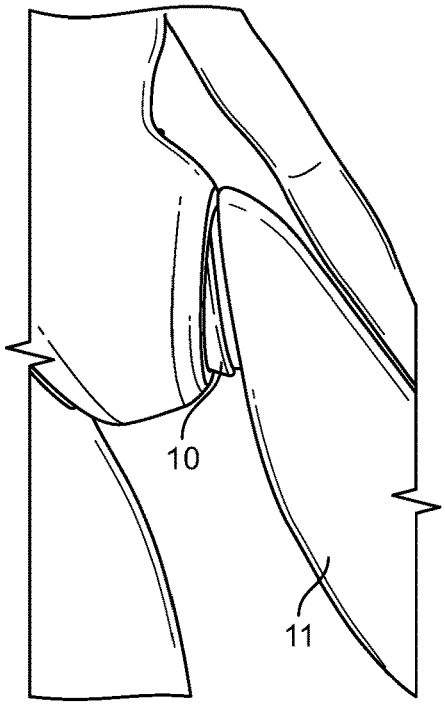
FIGS. 1D-1G depicts a leg and socket system showing a grooved femur ball.
Figure 1E:
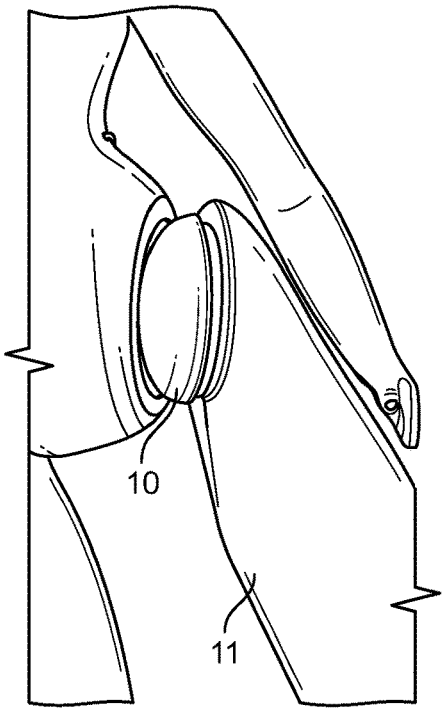
Figure 1F:
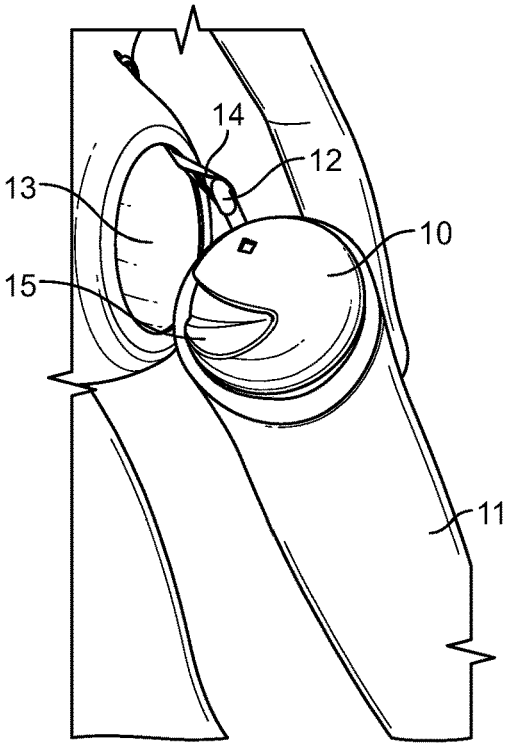
Figure 1G:
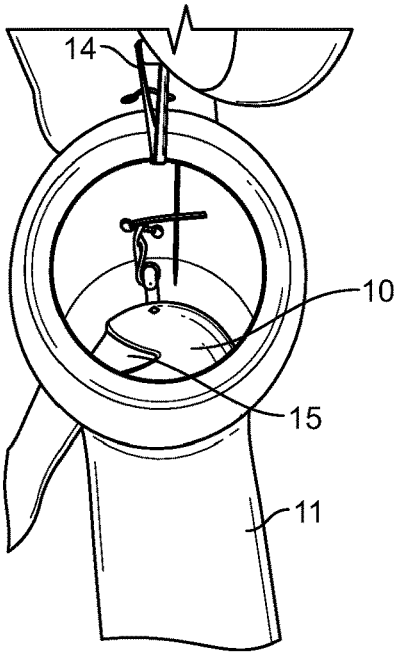

FIG. 1C (components not labeled for clarity but the same as in FIG. 1A), when the hook 12 is off-center to the right, the leg 11 is off-center to the left, and a restorative force tends to rotate the leg 11 in the counter-clockwise direction.

FIGS. 1D-1G depicts four positions of a leg 11, ball 10 incorporating groove 15, and hole or socket 13.

Figure 2A:
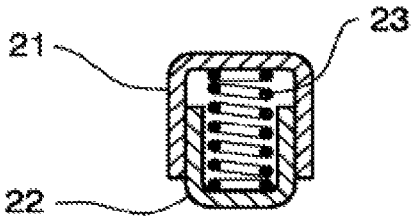
FIG. 2A depicts an expandable cam follower in the compressed position.

FIG. 2A depicts an expandable cam follower in the compressed position. Shown is top cap 21, bottom cap 22, and spring 23 contained between both, and compressed.

Figure 2B:
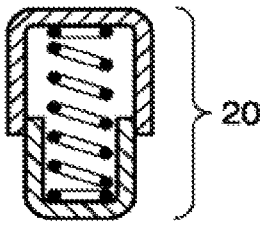
FIG. 2B depicts an expandable cam follower in the expanded position.

FIG. 2B depicts the same expandable cam follower of FIG. 2A in the expanded position. Components not labeled for clarity but the same as in FIG. 2A. The expandable cam follower can take a number of forms and is not limited to the exemplary embodiment depicted in the figures.

FIG. 3 depicts three positions of a simplified leg 11, ball 10, and hole or socket 13 system incorporating an expandable cam follower 20 and cam plate 25. For simplicity, elements of FIG. 1 are not shown.

Figures 3A, 3B, 3C:
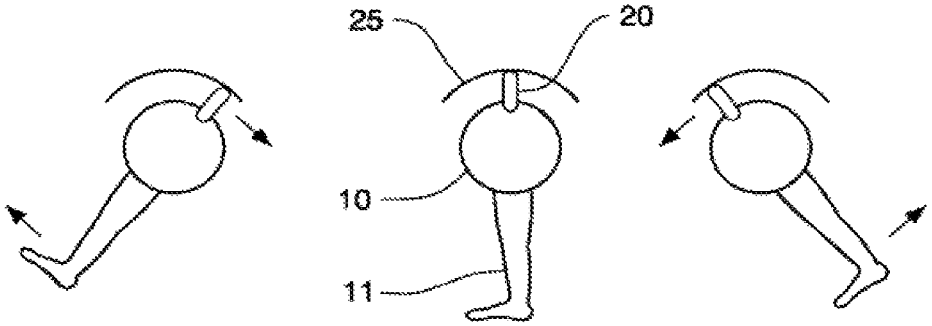
FIG. 3B depicts a centered position incorporating an expandable cam follower in the compressed position.
FIG. 3A depicts an off-centered position incorporating an expandable cam follower in the expanded position, thus producing a non-restorative force in the clockwise direction.
FIG. 3C depicts an off-centered position incorporating an expandable cam follower in the compressed position, thus producing a non-restorative force in the counter-clockwise direction.

FIG. 3B depicts a centered position incorporating expandable cam follower 20 in the compressed position of FIG. 2A, compressed between ball 10 and cam plate 25. In this centered position, the leg 11 is in a meta-stable position, and any offset from the centered position will tend to keep the leg 11 moving in the direction of the offset. Cam follower 20 can be located within and secured within the interior of ball 10.

FIG. 3A depicts an off-centered position incorporating expandable cam follower 20 in the expanded position of FIG. 2B, thus producing a non-restorative force in the clockwise direction. In other words, there is a tendency for the leg to want to move away from the centered position. Components not labeled for clarity but are the same as in FIG. 3B.

FIG. 3C depicts an off-centered position incorporating expandable cam follower 20 in the expanded position of FIG. 2B, thus producing a non-restorative force in the counter-clockwise direction. In other words, there is a tendency for the leg to want to move away from the centered position. Components not labeled for clarity but are the same as in FIG. 3B.

Figure 4:
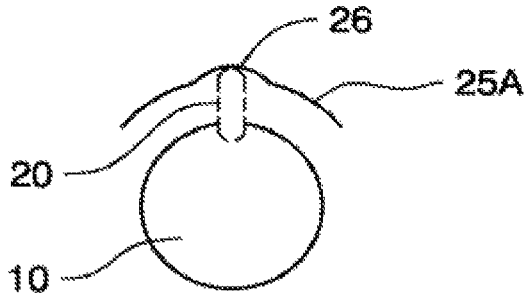
FIG. 4 depicts a non-linear restorative force employing an expandable cam follower and non-linear cam plate.

FIG. 4 depicts a non-linear restorative force employing the expandable cam follower 20 affixed to ball 10, and the expandable cam follower 20 compresses against the non-linear cam plate 25A. In this embodiment, the non-linear cam plate 25A incorporates concave dimple 26, thus tending to stabilize the ball 10 in the centered position, but when a certain off-center angle is reached, there is an increase in force to drive the ball 10 further off center as depicted in FIG. 3A and FIG. 3C.

Figure 5:
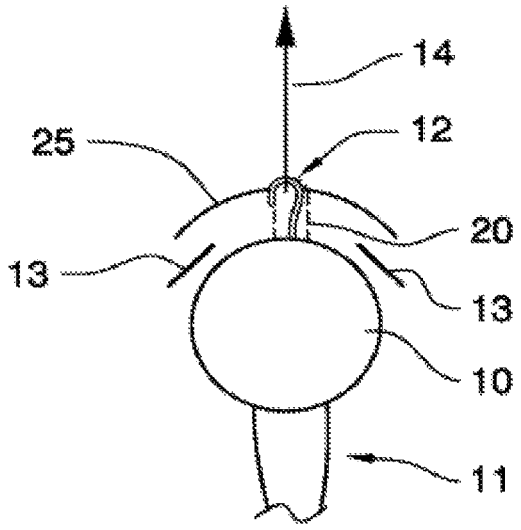
FIG. 5 depicts the superposition of elements of FIG. 1 and elements of FIG. 3.

FIG. 5 depicts the superposition of elements of FIG. 1 and elements of FIG. 3. Shown is the ball 10, with elastic band 14 attached to hook 12, thus pulling ball 10 into hole or socket 13. Also incorporated in this embodiment is expandable cam follower 20 compressing between ball 10 and cam plate 25. Cam plate 25 could just as easily be replaced with non-linear cam plate 25A. Only a portion of leg 11 is show. The principle being demonstrated is that when combining elements of FIG. 1 and FIG. 3, both restorative forces and non-restorative forces are additive, thus producing a resultant non-linear action when the doll is being assisted and walked by the user.

Figure 6A:
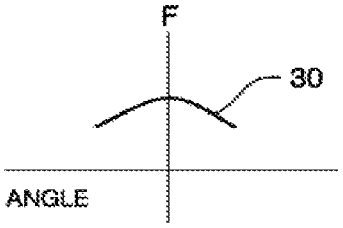
FIG. 6A depicts a qualitative graph of force vs. angle for the system shown in FIG. 1.

FIG. 6A depicts a qualitative graph of force vs. angle for the system shown in FIG. 1. Force is depicted on the vertical axis and angle is depicted on the horizontal axis. Restorative force vs. angle transfer function 30 demonstrates in this embodiment that the restorative force to drive the leg back to center position increases as the leg is displaced off-center.

Figure 6B:
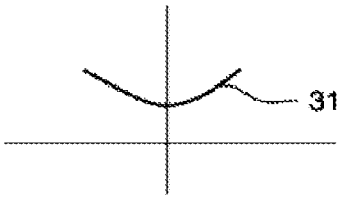
FIG. 6B depicts a qualitative graph of force vs. angle for the system shown in FIG. 3.

FIG. 6B depicts a qualitative graph of force vs. angle for the system shown in FIG. 3. Non-restorative force vs. angle transfer function 31 demonstrates in this embodiment that the restorative force to drive the leg back to center position decreases as the leg is displaced off-center, thus making the leg want to displace further off center the more the leg is displaced off-center.

Figure 6C:
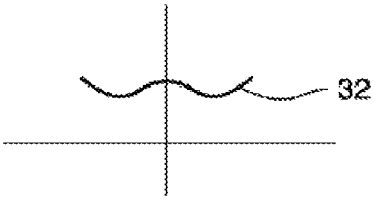
FIG. 6C depicts a qualitative graph of force vs. angle for the system shown in FIG. 4.

FIG. 6C depicts a qualitative graph of force vs. angle for the system shown in FIG. 4.

Combined restorative force vs. angle transfer function 32 is the superposition of restorative force vs. angle transfer function 30 and non-restorative force vs. angle transfer function 31. By controlling the shape of cam plate 25 and/or non-linear cam plate 25A or an arbitrary shape, and by adjusting the force ratios of elastic band 14 and spring 23 or an equivalent type of force in a mechanism producing an equivalent effect, it is possible to tune the action of the legs and how the doll feels during the motion of assisted walking, and this can dramatically improve the play pattern and feel and action of the doll.

While the instant invention has been shown and described in accordance with preferred and practical embodiments thereof, it is recognized that departures from the instant disclosure are contemplated and would remain within the spirit and scope of the present invention. Therefore, the true scope of the invention should not be limited since other modifications will become apparent to those skilled in the art upon a study of the claims, drawings, descriptions, explanations, and specifications herein.

A portion of the disclosure of this patent document contains material to which a claim for copyright is made. The copyright owner has no objection to the facsimile reproduction by anyone of the patent document or the patent disclosure, as it appears in the Patent and Trademark Office patent file or records, but reserves all other copyright rights whatsoever.

Component List for Drawings

Following is a partial list of the components depicted in the drawings:

| Component Number | Component Description |
|---|---|
| 10 | ball |
| 11 | leg |
| 12 | hook |
| 13 | hole or socket |
| 14 | elastic band |
| 20 | expandable cam follower |
| 21 | top cap |
| 22 | bottom cap |
| 23 | spring |
| 25 | cam plate |
| 25A | A non-linear cam plate |
| 26 | concave dimple |
| 30 | Restorative force vs. angle transfer function |
| 31 | Non-restorative force vs. angle transfer function |
| 32 | Combined restorative force vs. angle transfer function |

DEFINITIONS

These definitions are in addition to the words and phrases specifically defined in the body of this application.

In the context of this invention, an elastic band can be anything from a rubber band to a spring or anything that performs the equivalent mechanical spring-like function of generating a restorative force in a mechanical member when the mechanical member is pulled and extended in length from a lesser state of elongation to a greater state of elongation, thus producing a force in tension to restore the elongated member to a length of lesser elongation. Further, a spring that operates in tension and/or compression can just as easily be a leaf spring or folded leaf spring similar to the shape of a safety pin, a plastic living spring, or it can be a compressible piece of rubber or other spongy material that can be compressed and can return to an unstressed position depending on compression.

As used herein, the term "and/or," when used in a list of two or more items, means that any one of the listed items can be employed by itself, or any combination of two or more of the listed items can be employed. For example, if a device is described as containing components A, B, and/or C, the composition can contain A alone; B alone; C alone; A and B in combination; A and C in combination; B and C in combination; or A, B, and C in combination.

What is claimed:

1. A method of operating an assisted walking doll comprising of the following steps: a. supporting said assisted walking doll by holding at least one arm; b. tilting said assisted doll to the left such that the majority of the doll's weight is supported on the doll's left leg and leading the doll forward so the right leg moves in front of the left leg such that said right leg and said left leg form an angular separation between a finite angle of separation and a maximum angle limited by the freedom of the left leg mechanism, or tilting said assisted doll to the right such that the majority of the doll's weight is supported on the doll's right leg and leading the doll forward so the left leg moves in front of the right leg such that said left leg and said right leg form an angular separation between a finite angle of separation and a maximum angle limited by freedom of the right leg mechanism; c. tilting said assisted doll from the left to the right such that the majority of the doll's weight is supported on the doll's right leg and leading the doll forward so the left leg moves in front of the right leg such that said left leg and said right leg form an angular separation between a finite angle of separation and a maximum angle limited by the freedom of the right leg mechanism, or tilting said assisted doll to from the right to the left such that the majority of the doll's weight is supported on the doll's left leg and leading the doll forward so the right leg moves in front of the left leg such that said right leg and said left leg form an angular separation between a finite angle of separation and a maximum angle limited by the freedom of the left leg mechanism; d. repeating step c any number of times; whereby the assisted walking doll is comprised of: a torso with a left hole or socket and a right hole or socket, two moveable arms, and head; a left leg with a left femur ball at one end, said left femur ball having attached a left leg hook; a left attachment zone located on the left side of said torso; a left elastic band with a first end attaching to said left leg hook and a second end attaching to said left attachment zone, said left elastic band being stretched in tension, and thus generating a compressive force between said left femur ball and said left hole or socket; a right leg with a right femur ball at one end, said right femur ball having attached a right leg hook; a right attachment zone located on the right side of said torso; a right elastic band with a first end attaching to said right leg hook and a second end attaching to said right attachment zone, said right elastic band being stretched in tension, and thus generating a compressive force between said right femur ball and said right hold or socket.

2. The method of claim 1 whereby the left femur ball is grooved, with said left leg being stabilized by the groove of said left grooved femur ball being mated with said left hole or socket; whereby the right femur ball is grooved, said right leg being stabilized by the groove of said right grooved femur ball being mated with said right hole or socket.

3. The method of claim 2 wherein said left hole or socket that mates with the groove of said left grooved femur ball is oriented to travel within a left plane diagonally oriented to the central axis of said torso and said right hole or socket that mates with the groove of said right grooved femur ball is oriented to travel within a right plane diagonally oriented to the central axis of said torso, and said left plane is a mirror image of said right plane relative to a vertically oriented plane passing from the front of said torso to the back of said torso.

4. The method of claim 1 whereby the assisted walking doll further comprises a restorative force alteration subsystem.

5. The method of claim 4 whereby the restorative force alteration subsystem comprises a left cam plate fixed within said torso and an expandable left cam follower attached to or incorporated within said left grooved femur ball and a right cam plate fixed within said torso and an expandable right cam follower attached to or incorporated within said right grooved femur ball.

6. The method of claim 5 wherein said left cam plate produces a lesser or different restorative force than would be experienced without said restorative force alteration subsystem by said left leg when angularly displaced off the center line created by said left leg and said torso and said right cam plate produces a lesser and/or different restorative force than would be experienced without said restorative force alteration subsystem by said right leg when angularly displaced off the center line created by said right leg and said torso.

7. A method of operating an assisted walking doll comprising of the following steps: a. supporting said assisted walking doll by holding at least one arm; b. tilting said assisted doll to the left such that the majority of the doll's weight is supported on the doll's left leg and leading the doll forward so the right leg moves in front of the left leg such that said right leg and said left leg form an angular separation between a finite angle of separation and a maximum angle limited by the freedom of the left leg mechanism, or tilting said assisted doll to the right such that the majority of the doll's weight is supported on the doll's right leg and leading the doll forward so the left leg moves in front of the right leg such that said left leg and said right leg form an angular separation between a finite angle of separation and a maximum angle limited by freedom of the right leg mechanism; c. tilting said assisted doll from the left to the right such that the majority of the doll's weight is supported on the doll's right leg and leading the doll forward so the left leg moves in front of the right leg such that said left leg and said right leg form an angular separation between a finite angle of separation and a maximum angle limited by the freedom of the right leg mechanism, or tilting said assisted doll to from the right to the left such that the majority of the doll's weight is supported on the doll's left leg and leading the doll forward so the right leg moves in front of the left leg such that said right leg and said left leg form an angular separation between a finite angle of separation and a maximum angle limited by the freedom of the left leg mechanism; d. repeating step c any number of times; whereby the assisted walking doll is comprised of: a torso with a left hole or socket and a right hole or socket, two moveable arms, and head; a left leg with a left grooved femur ball at one end, said left grooved femur ball having attached a left leg hook; a left attachment zone located on the left side of said torso; a left elastic band with a first end attaching to said left leg hook and a second end attaching to said left attachment zone, said left elastic band being stretched in tension, and thus generating a compressive force between said left grooved femur ball and said left hole or socket, with said left leg being stabilized by the groove of said left grooved femur ball being mated with said left hole or socket; a right leg with a right grooved femur ball at one end, said right grooved femur ball having attached a right leg hook; a right attachment zone located on the right side of said torso; a right elastic band with a first end attaching to said right leg hook and a second end attaching to said right attachment zone, said right elastic band being stretched in tension, and thus generating a compressive force between said right grooved femur ball and said right hole or socket, with said right leg being stabilized by the groove of said right grooved femur ball being mated with said right hole or socket.

8. The method of claim 7 whereby the assisted walking doll further comprises a restorative force alteration subsystem.

9. The method of claim 8 whereby the restorative force alteration subsystem comprises a left cam plate fixed within said torso and an expandable left cam follower attached to or incorporated within said left grooved femur ball and a right cam plate fixed within said torso and an expandable right cam follower attached to or incorporated within said right grooved femur ball.

10. The method of claim 9 wherein said left cam plate produces a lesser or different restorative force than would be experienced without said restorative force alteration subsystem by said left leg when angularly displaced off the center line created by said left leg and said torso and said right cam plate produces a lesser and/or different restorative force than would be experienced without said restorative force alteration subsystem by said right leg when angularly displaced off the center line created by said right leg and said torso.

11. The method of claim 7 wherein said left hole or socket that mates with the groove of said left grooved femur ball is oriented to travel within a left plane diagonally oriented to the central axis of said torso and said right hole or socket that mates with the groove of said right grooved femur ball is oriented to travel within a right plane diagonally oriented to the central axis of said torso, and said left plane is a mirror image of said right plane relative to a vertically oriented plane passing from the front of said torso to the back of said torso.

* * * * *